US008863754B2

(12) United States Patent
Renaud et al.

(10) Patent No.: US 8,863,754 B2
(45) Date of Patent: Oct. 21, 2014

(54) AEROSOL-GENERATING SUBSTRATE FOR SMOKING ARTICLES

(75) Inventors: Jean-Marc Renaud, Peseux (CH); Jean-Jacques Pladé, Hauterive (CH); Jacques Zuber, Vétroz (CH); Fabien Zuchuat, Sion (CH); Anu Ajithkumar, Neuchâtel (CH); Samuel Bonnely, Cormondréche (CH); Johannes Petrus Maria Pijnenburg, Neuchâtel (CH)

(73) Assignee: Phillip Morris USA Inc., Richmond, VA (US)

( * ) Notice: Subject to any disclaimer, the term of this patent is extended or adjusted under 35 U.S.C. 154(b) by 801 days.

(21) Appl. No.: 13/032,351

(22) Filed: Feb. 22, 2011

(65) Prior Publication Data

US 2012/0006343 A1 Jan. 12, 2012

(30) Foreign Application Priority Data

Feb. 19, 2010 (EP) ..... 10250295

(51) Int. Cl.

| | |
|---|---|
| ***A24F 47/00*** | (2006.01) |
| ***A24B 15/16*** | (2006.01) |
| ***A24B 15/12*** | (2006.01) |

(52) U.S. Cl.

CPC ..... *A24B 15/165* (2013.01); *A24F 47/002* (2013.01); *A24B 15/12* (2013.01)

USPC ..... 131/347; 131/360; 131/364; 131/194

(58) Field of Classification Search

CPC ..... A24B 15/12; A24B 15/165; A24F 47/002

USPC ..... 131/352, 347, 360, 364, 194

See application file for complete search history.

(56) References Cited

U.S. PATENT DOCUMENTS

| | | | |
|---|---|---|---|
| 3,894,544 | A | 7/1975 | Egri |
| 4,981,522 | A | 1/1991 | Nichols et al. |
| 5,724,998 | A | 3/1998 | Gellatly et al. |

FOREIGN PATENT DOCUMENTS

| | | |
|---|---|---|
| GB | 983928 | 2/1965 |
| WO | WO 99/63844 | 12/1999 |
| WO | WO 2009/022232 A2 | 2/2009 |

OTHER PUBLICATIONS

European Search Report dated Aug. 25, 2010 for European Application No. 10 25 0295.

Interntional Search Report and Written Opinion mailed May 23, 2011 for PCT/EP2011/000800.

International Preliminary Report on Patentability issued Aug. 21, 2012 for PCT/EP2011/000800.

*Primary Examiner* — Richard Crispino

*Assistant Examiner* — Dionne Walls Mayes

(74) *Attorney, Agent, or Firm* — Buchanan Ingersoll & Rooney PC

(57) ABSTRACT

Strands of homogenized tobacco material include at least one aerosol former, An aerosol-generating substrate includes a plurality of those strands of homogenized tobacco material. A smoking article may further include the aerosol-generating substrate. Those strands of homogenized tobacco material preferably have a mass-to-surface-area ratio of at least about 0.09 mg/mm$^2$ and an aerosol former content of between about 12% and about 25% by weight.

13 Claims, 3 Drawing Sheets

AEROSOL-GENERATING SUBSTRATE FOR SMOKING ARTICLES

CROSS-REFERENCE TO RELATED APPLICATION

This application claims foreign priority under 35 U.S.C. §119 and 37 C.F.R. §1.55 to European Patent Application EP 10250295.2, filed Feb. 19, 2010, the entire contents of which are incorporated herein by this reference thereto.

FIELD OF INVENTION

The present invention broadly concerns an aerosol-generating substrate for smoking articles. More particularly, the present invention relates to a strand of homogenized tobacco material, an aerosol-generating substrate having a plurality of strands of homogenized tobacco material, and a smoking article having an aerosol-generating substrate.

OVERVIEW OF SELECTED ASPECTS OF THE DISCLOSURE

A number of smoking articles in which tobacco is heated rather than combusted have been proposed in the art. The aim of such heated smoking articles is to reduce known harmful smoke constituents produced by the combustion and pyrolytic degradation of tobacco in conventional cigarettes. Typically in heated smoking articles, an aerosol is generated by the transfer of heat from a chemical or combustible fuel element or heat source to a physically separate aerosol-generating substrate, which may be located within, around or downstream of the heat source. In use the combustible heat source of the heated smoking article is lit and volatile compounds released from the aerosol-generating substrate by heat transfer from the combustible heat source are entrained in air drawn through the heated smoking article. As the released compounds cool they condense to form an aerosol that is inhaled by the consumer.

For example, WO-A2-2009/022232 discloses a smoking article comprising a combustible heat source, an aerosol-generating substrate downstream of the combustible heat source and a heat-conducting element around and in contact with a rear portion of the combustible heat source and an adjacent front portion of the aerosol-generating substrate, wherein the aerosol-generating substrate extends at least about 3 mm downstream beyond the heat-conducting element.

Heated smoking articles comprising a combustible heat source are high-energy devices that typically produce an excess of energy during use. To be used successfully in such a heated smoking article, an aerosol-generating substrate must be capable of releasing sufficient volatile compounds to produce a sensorially acceptable aerosol at temperatures produced within the aerosol-generating substrate due to heat transfer from the combustible heat source. However, combustion or pyrolytic degradation of the aerosol-generating substrate at such temperatures, which could give rise to undesirable aerosol constituents, must also be avoided.

A number of tobacco-containing and non-tobacco-containing aerosol-generating substrates for use in heated smoking articles have been proposed in the art.

For example, U.S. Pat. No. 4,981,522 discloses a thermally releasable flavor source for smoking articles that includes tobacco particles, an aerosol precursor that forms an aerosol upon exposure to heat, and a filler material that absorbs and radiates heat to minimize the likelihood that the flavor material will ignite.

There is still a need for a tobacco-containing aerosol-generating substrate for use in heated smoking articles of the type described above that is capable of producing a sensorially acceptable aerosol, but that also has a sufficiently high resistance to combustion to substantially avoid combustion or pyrolytic degradation thereof during use of the heated smoking article.

BRIEF DESCRIPTION OF THE DRAWINGS

The invention will be further described, by way of example only, with reference to the accompanying drawings in which like reference numerals are applied to like elements and wherein.

DETAILED DESCRIPTION

Figure 1:
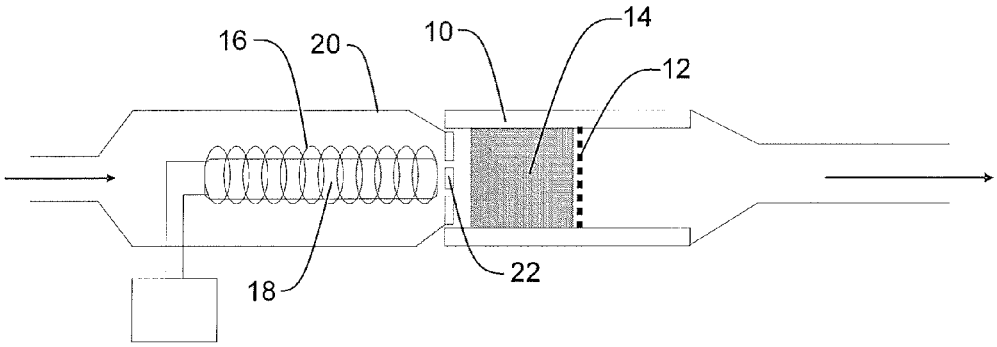
FIG. 1 shows a schematic cross-section of apparatus for heating aerosol-generating substrates by convective heat transfer.
Figure 2:
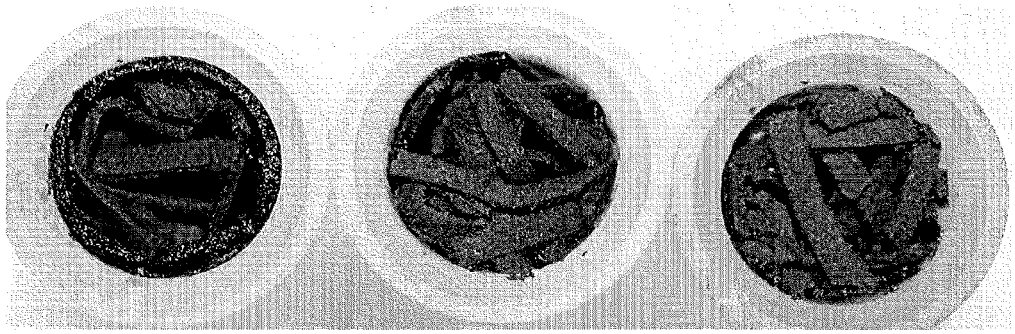
FIG. 2 shows strands of homogenized tobacco material having a mass-to-surface-area ratio of 0.21 mg/mm$^2$ and an aerosol former content of 25% according to a first embodiment of the invention after convective heating thereof.
Figure 3:
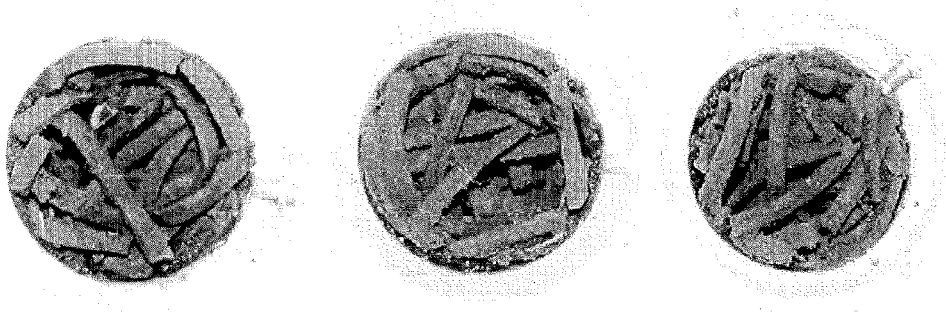
FIG. 3 shows strands of homogenized tobacco material having a mass-to-surface-area ratio of 0.16 mg/mm$^2$ and an aerosol former content of 20% according to a second embodiment of the invention after convective heating thereof.
Figure 4:
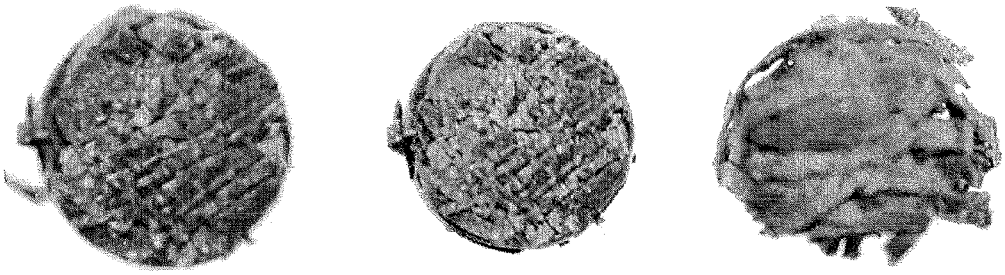
FIG. 4 shows strands of homogenized tobacco material having a mass-to-surface-area ratio of 0.10 mg/mm$^2$ and an aerosol former content of 15% according to a third embodiment of the invention after convective heating thereof.
Figure 5:
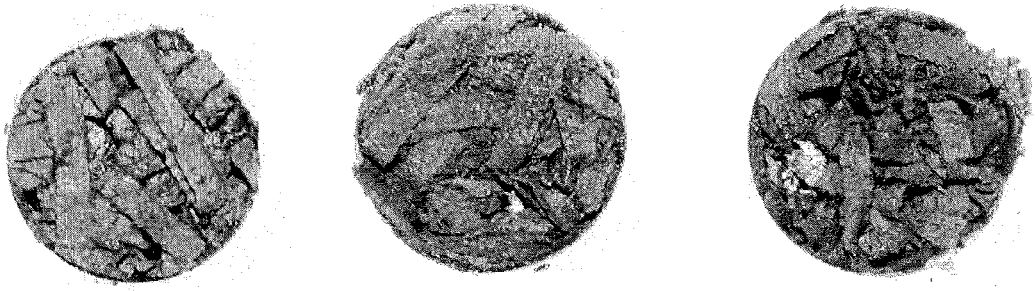
FIG. 5 shows strands of homogenized tobacco material having a mass-to-surface-area ratio of 0.11 mg/mm$^2$ and an aerosol former content of 15% according to a fourth embodiment of the invention after convective heating thereof.

According to the invention, a strand of homogenized tobacco material may include an aerosol former characterized in that the strand has a mass-to-surface-area ratio of at least about 0.09 mg/mm$^2$ and an aerosol former content of between about 12% and about 25% by weight.

As used herein, the term "strand" denotes a strip, shred, filament, rod or other elongate element.

As used herein, the term "homogenized tobacco material" denotes a material formed by agglomerating particulate tobacco. To help agglomerate the particulate tobacco, homogenized tobacco material may comprise one or more intrinsic binders (that is, tobacco endogenous binders), one or more extrinsic binders (that is, tobacco exogenous binders) or a combination thereof. Alternatively, or in addition, homogenized tobacco material may comprise other additives including, but not limited to, aerosol-formers, flavorants, plasticizers, humectants, tobacco and non-tobacco fibers, fillers, aqueous and non-aqueous solvents and combinations thereof. Strands of homogenized tobacco material according to the invention have an aerosol former content of between about 12% and about 25% by weight.

According to the invention a strand of homogenized tobacco material may be used in an aerosol-generating substrate of a smoking article.

According to the invention, there is further provided an aerosol-generating substrate for a smoking article comprising a plurality of strands of homogenized tobacco material.

As used herein, the term "aerosol-generating substrate" denotes a substrate capable of releasing volatile compounds upon heating to generate an aerosol.

It will be appreciated that aerosol-generating substrates according to the invention may have different shapes and sizes depending upon, for example, the type of smoking article in which they are intended to be used. Aerosol-generating substrates according to the invention may be substantially three-dimensional. For example, aerosol-generating substrates according to the invention may be bricks, plugs, or tubes comprising a plurality of strands of homogenized tobacco material according to the invention. Alternatively, aerosol-generating substrates according to the invention may be substantially two-dimensional. For example, aerosol-generating substrates according to the invention may be mats or sheets comprising a plurality of strands of homogenized tobacco material according to the invention.

As used herein, the term "plurality of strands of homogenized tobacco material" denotes any number of strands of homogenized tobacco material capable of releasing sufficient volatile compounds upon heating to generate a sensorially acceptable aerosol. For example, aerosol-generating substrates according to the invention may comprise between about 20 strands and about 150 strands of homogenized tobacco material according to the invention.

According to the invention, a smoking article includes a heat source, and an aerosol-generating substrate.

As described further below, the mass-to-surface-area ratio and aerosol former content of strands of homogenized tobacco material in combination advantageously prevent localization of heat transferred to aerosol-generating substrates from the heat sources of heated smoking articles during use thereof. This advantageously avoids aerosol-generating substrates according to the invention reaching temperatures required for combustion or pyrolytic degradation of strands of homogenized tobacco material according to the invention therein.

In use, aerosol-generating substrates in heated smoking articles may be heated by: conductive heat transfer, when the aerosol-generating substrate is in direct contact with the heat source or a heat-conducting element of the heated smoking article; by radiative heat transfer; and by convective heat transfer, when air heated by the heat source passes over the aerosol-generating substrate.

Without wishing to be bound by theory, convective heat transfer is considered to have a high potential to overheat homogenized tobacco material locally during drawing of hot air there through, and so may result in combustion or pyrolytic degradation of an aerosol-generating substrate comprising homogenized tobacco materials during use of a heated smoking article.

Strands of homogenized tobacco material according to the invention are advantageously capable of withstanding different modes of heat transfer, including convective heat transfer, due to their high mass-to-surface-area ratio and aerosol former content.

The mass-to-surface-area ratio is calculated by dividing the mass of the strand of homogenized tobacco material by the geometric surface area of the strand of homogenized tobacco material in accordance with the following equation:

$$\frac{\text{mass of strand of homogenized tobacco material (mg)}}{\text{surface area of strand of homogenized tobacco material (mm}^2\text{)}}$$

Strands of homogenized tobacco material according to the invention have a mass-to-surface-area ratio of at least about 0.09 mg/mm$^2$. Preferably, strands of homogenized tobacco material according to the invention have a mass-to-surface-area ratio of at least about 0.1 mg/mm$^2$. More preferably, strands of homogenized tobacco material according to the invention have a mass-to-surface-area ratio of at least about 0.12 mg/mm$^2$.

Preferably, strands of homogenized tobacco material according to the invention have a mass-to-surface-area ratio of less than or equal to about 0.25 mg/mm$^2$.

The high mass-to-surface-area ratio of at least 0.09 mg/mm$^2$ of strands of homogenized tobacco material according to the invention provides an increase in the mass available to be heated per unit surface area, which results in an increased ability to assimilate energy per unit surface area. In use, this ensures a lower local increase in temperature in response to heat transfer, and so advantageously delays strands of homogenized tobacco material according to the invention from reaching a temperature required for combustion or pyrolytic degradation thereof.

In addition, the high mass-to-surface-area ratio of at least 0.09 mg/mm$^2$ of strands of homogenized tobacco material according to the invention restricts the availability of oxygen within the strands required for combustion thereof. In use, this also advantageously delays strands of homogenized tobacco material according to the invention from reaching a temperature required for combustion or pyrolytic degradation thereof in response to heat transfer.

Strands of homogenized tobacco material according to the invention having a mass-to-surface-area ratio of at least about 0.09 mg/mm$^2$ thus exhibit improved resistance to combustion compared to strands of homogenized tobacco having a lower mass-to-surface-area ratio.

To assess resistance to combustion, visual confirmation of combustion may be obtained by the observation of combustion spots (white ashes against the dark tobacco) on the surface of strands of homogenized tobacco material after heating. This allows a qualitative ranking of the resistance to combustion of strands of homogenized tobacco material.

In addition, a semi-quantitative determination of combustion may be obtained through measurement of the isoprene content of the aerosol generated by strands of homogenized tobacco material in response to heating. The isoprene content of the aerosol may be measured by suitable techniques know in the art such as, for example, gas chromatography.

Isoprene is a pyrolysis product of isoprenoid compounds present in tobacco, for example in certain tobacco waxes, and can be present in the aerosol only if the strands of homogenized tobacco material are heated to a temperature substantially higher than that required to generate an aerosol. Thus, isoprene yield can be taken as representative of the amount of homogenized tobacco material that is "over heated".

Factors that affect the mass to surface ratio of a strand of homogenized tobacco material are the morphology (that is, the shape and dimensions) of the strand and the density of the homogenized tobacco material.

The density of homogenized tobacco material determines the mass of a body of homogenized tobacco material of given volume and the packing efficiency of a given surface area of homogenized tobacco material.

The density of a homogenized tobacco material is normally largely determined by the type of process used for the manufacture thereof. A number of reconstitution processes for producing homogenized tobacco materials are known in the art. These include, but are not limited to: paper-making processes of the type described in, for example, U.S. Pat. No. 5,724,998; casting processes of the type described in, for example, U.S. Pat. No. 5,724,998; dough reconstitution processes of the type described in, for example, U.S. Pat. No. 3,894,544; and extrusion processes of the type described in, for example, in GB-A-983,928.

Typically, the densities of homogenized tobacco materials produced by extrusion processes and dough reconstitution processes are greater than the densities of homogenized tobacco materials produced by casting processes. The densities of homogenized tobacco materials produced by extrusion processes can be greater than the densities of homogenized tobacco materials produced by dough reconstitution processes.

Preferably, strands of homogenized tobacco material according to the invention have a density of between about 1100 mg/cm$^3$ and about 1500 mg/cm$^3$, more preferably of between about 1100 mg/cm$^3$ and about 1450 mg/cm$^3$, most preferably of between about 1125 mg/cm$^3$ and about 1375 mg/cm$^3$.

The mass-to-surface-area ratio of homogenized tobacco materials may be adjusted by altering the shape and dimensions thereof.

Preferably, strands of homogenized tobacco material according to the invention have a length of less than about 15 mm. For example, strands of homogenized tobacco material according to the invention may have a length between about 5 mm and about 15 mm.

As used herein, the term 'length' denotes the dimension in the longitudinal direction of strands of homogenized tobacco material according to the invention.

Preferably, strands of homogenized tobacco material according to the invention have a minimum transverse dimension of at least about 0.2 mm, more preferably of at least about 0.3 mm.

As used herein, the term 'transverse dimension' denotes a dimension substantially perpendicular to the longitudinal direction of strands of homogenized tobacco material according to the invention.

Preferably, strands of homogenized tobacco material according to the invention are substantially cylindrical.

Preferably, strands of homogenized tobacco material according to the invention are of substantially square transverse cross-section, substantially rectangular transverse cross-section or substantially circular transverse cross-section.

Strands of homogenized tobacco material according to the invention of substantially square cross-section or substantially rectangular cross-section preferably have a transverse cross-section of W×T, wherein W is the width of the strand and is between about 0.5 mm and about 1.5 mm, more preferably between about 0.7 mm and about 1.1 mm, most preferably between about 0.8 mm and about 1.0 mm, and T is the thickness of the strand and is between about 0.18 mm and about 0.6 mm, more preferably between about 0.25 mm and about 0.5 mm, most preferably between about 0.35 mm and about 0.5 mm.

Strands of homogenized tobacco material according to the invention of substantially circular cross-section preferably have a diameter of between about 0.25 mm and about 0.8 mm.

Strands of homogenized tobacco material according to the invention have an aerosol former content of between about 12% and about 25% by weight. In use, the high aerosol former content of between about 12% and about 25% by weight strands of homogenized tobacco material according to the invention facilitates production of a sensorially acceptable aerosol from the strands of homogenized tobacco material in response to heat transfer.

As well as facilitating production of a sensorially acceptable aerosol, the high aerosol former content of between about 12% and about 25% by weight of strands of homogenized tobacco material according to the invention also advantageously delays combustion and pyrolytic degradation of the strands of homogenized tobacco material due to its latent heat of vaporization.

Preferably, strands of homogenized tobacco material according to the invention have an aerosol former content of between about 15% and about 25% by weight.

The aerosol former may be any suitable known compound or mixture of compounds that, in use, facilitates formation of a dense and stable aerosol and that is substantially resistant to thermal degradation at temperatures typically produced within the aerosol-generating means of heated smoking articles during use thereof. Suitable aerosol formers are well known in the art and include, but are not limited to: polyhydric alcohols such as, for example, triethylene glycol, 1,3-butanediol, propylene glycol and glycerin; esters of polyhydric alcohols such as, for example, glycerol mono-, di- or triacetate; aliphatic esters of mono-, di- or polycarboxylic acids such as, for example, dimethyl dodecanedioate and dimethyl tetradecanedioate; and combinations thereof.

Preferably, the aerosol former is one or more polyhydric alcohols. Most preferably, the aerosol former is glycerin.

In use, the increased ability to assimilate energy per unit surface area of strands of homogenized tobacco according to the invention resulting from the combination of their high mass-to-surface-area ratio of at least 0.09 mg/mm$^2$ and their high aerosol former content of between about 12% and about 25% by weight results in lower local increases of temperature within aerosol-generating substrates according to the invention in response to heat transfer from a heat source. Strands of homogenized tobacco material according to the invention are thereby advantageously delayed or prevented from reaching temperatures required for combustion or pyrolytic degradation thereof during use of smoking articles according to the invention.

Strands of homogenized tobacco material according to the invention may be formed using known reconstitution processes of the type previously described above. Preferably, strands of homogenized tobacco material according to the invention are formed by a dough reconstitution process or an extrusion process. Most preferably, strands of homogenized tobacco material according to the invention are formed by an extrusion process.

For example, in one embodiment, strands of homogenized tobacco material according to the invention of substantially square cross-section or substantially rectangular cross-section may be formed by casting, rolling, calendering or extruding a mixture comprising particulate tobacco and at least one aerosol former to form a sheet of homogenized tobacco material having an aerosol former content of between about 12% and about 25% by weight and then shredding the sheet of homogenized tobacco material into individual strands having a mass-to-surface-area ratio of between about 0.09 mg/mm$^2$ and about 0.25 mg/mm$^2$.

In an alternative embodiment, strands of homogenized tobacco material according to the invention of substantially square cross-section, substantially rectangular cross-section or substantially circular cross-section may be formed by extruding a mixture comprising particulate tobacco and at least one aerosol former to form continuous lengths of homogenized tobacco material having an aerosol former content of between about 12% and about 25% by weight and then cutting the continuous lengths of homogenized tobacco material into individual strands having a mass-to-surface-area ratio of between about 0.09 mg/mm$^2$ and about 0.25 mg/mm$^2$.

When strands of homogenized tobacco material according to the invention are formed by an extrusion process, conventional single or twin-screw extruders may be used in the extrusion process.

Preferably, strands of homogenized tobacco material according to the invention have a tobacco content of between about 40% and about 85% by weight, more preferably of between about 50% and about 75% by weight.

Strands of homogenized tobacco material according to the invention may comprise particulate tobacco obtained by grinding or otherwise comminuting one or both of tobacco leaf lamina and tobacco leaf stems. Alternatively, or in addition, strands of homogenized tobacco material according to the invention may comprise one or more of tobacco dust, tobacco fines and other particulate tobacco by-products formed during, for example, the treating, handling and shipping of tobacco.

Preferably, strands of homogenized tobacco according to the invention are formed from particulate tobacco having a particle size of between about 40 microns and about 500 microns.

Strands of homogenized tobacco material according to the invention may further comprise one or more flavorants. Suitable flavorants are known in the art and include, but are not limited to, menthol, spearmint, peppermint, eucalyptus, vanilla, cocoa, chocolate, coffee, tea, spices (such as cinnamon, clove and ginger), fruit flavorants and combinations thereof.

Preferably, strands of homogenized tobacco according to the invention have a flavorant content of about 10% by weight or less.

The one or more flavorants may be added to particulate tobacco before, during or after agglomeration of the particulate tobacco to form strands of homogenized tobacco material according to the invention.

For example, when strands of homogenized tobacco material according to the invention are formed by an extrusion process, one or more flavorants may be added to a mixture of particulate tobacco and at least one aerosol former before, during or after extrusion of the mixture.

Alternatively or in addition to one or more flavorants, strands of homogenized tobacco material according to the invention may further include other additives conventionally included in known homogenized tobacco materials. Such additives include, but are not limited to, humectants, plasticizers, binders, non-tobacco fibers and mixtures thereof.

Preferably, strands of homogenized tobacco material according to the invention are substantially free of extrinsic binders (that is, tobacco exogenous binders). However, it will be appreciated that strands of homogenized tobacco material according to the invention may comprise one or more extrinsic binders if desired. Suitable extrinsic binders for inclusion in strands of homogenized tobacco material according to the invention are known in the art and include, but are not limited to: cellulosic binders such as, for example, hydroxypropyl cellulose, carboxymethyl cellulose, hydroxyethyl cellulose, methyl cellulose and ethyl cellulose; gums such as, for example, xanthan gum, guar gum, arabic gum and locust bean gum; polysaccharides such as, for example, starches, organic acids, such as alginic acid, conjugate base salts of organic acids, such as sodium-alginate, agar and pectins; and combinations thereof.

Preferably, strands of homogenized tobacco material according to the invention have an extrinsic binder content of less than about 3% by weight, more preferably of less than about 0.5% by weight, most preferably of less than about 0.1% by weight.

Preferably, strands of homogenized tobacco material according to the invention are substantially free of non-tobacco fibers. However, it will be appreciated that strands of homogenized tobacco material according to the invention may comprise non-tobacco fibers if desired. Suitable non-tobacco fibers for inclusion in strands of homogenized tobacco material according to the invention are known in the art and include, but are not limited to, processed organic fibers such as, for example, soft-wood fibers, hard-wood fibers, jute fibers and combinations thereof. Prior to inclusion in strands of homogenized tobacco material according to the invention, non-tobacco fibers may be treated by suitable processes known in the art including, but not limited to: mechanical pulping; refining; chemical pulping; bleaching; sulfate pulping; and combinations thereof.

In one preferred embodiment of the invention, the strands of homogenized tobacco material comprise only particulate tobacco, one or more aerosol formers, water and optionally one or more flavorants. Strands of homogenized tobacco material according to this preferred embodiment of the invention may, for example, have a tobacco content of between about 40% and about 85% by weight, an aerosol former content of between about 12% and about 25% by weight, a water content of between about 10% and about 20% by weight and a flavorant content of between about 0% and about 10% by weight.

According to the invention, there is provided an aerosol-generating substrate for a heated smoking article comprising a plurality of individual strands of homogenized tobacco material comprising at least one aerosol former characterised in that the individual strands of homogenized tobacco material have a mass-to-surface-area ratio of between about 0.09 mg/mm$^2$ and about 0.25 mg/mm$^2$ and an aerosol former content of between about 12% and about 25% by weight.

According to the invention there is also provided use of an aerosol-generating substrate according to the invention in a smoking article.

The plurality of individual strands of homogenized tobacco material may or may not be aligned within the aerosol-generating substrate. Preferably, the strands of homogenized tobacco material are aligned substantially parallel to one another within the aerosol-generating substrate. In use, this promotes the distribution of heat within the aerosol-generating substrate, and so advantageously reduces the likelihood of "hot spots" occurring therein that could lead to combustion or pyrolytic degradation of the strands of homogenized tobacco material.

Preferably, the strands of homogenized tobacco material are of substantially uniform transverse cross-section.

Advantageously, the strands of homogenized tobacco material are circumscribed by a wrapper of, for example, paper, such as filter plug wrap. The inclusion of a suitable wrapper advantageously facilitates assembly of aerosol-generating substrates and smoking articles according to the invention.

Preferably, aerosol-generating substrates according to the invention are substantially cylindrical in shape and of substantially uniform transverse cross-section.

Preferably, aerosol-generating substrates according to the invention are of substantially circular or substantially elliptical transverse cross-section.

Aerosol-generating substrates according to the invention may be produced using known processes and equipment for forming plugs of tobacco cut filler for conventional lit-end combustible smoking articles.

Aerosol-generating substrates according to the invention are particularly suited for use in heated smoking articles of the type disclosed in WO-A-2009/022232, which comprise a combustible heat source, an aerosol-generating substrate downstream of the combustible heat source, and a heat-conducting element around and in contact with a rear portion of the combustible heat source and an adjacent front portion of the aerosol-generating substrate. In the heated smoking articles disclosed in WO-A-2009/022232, the aerosol-generating substrate extends at least about 3 mm downstream beyond the heat-conducting element.

However, it will be appreciated that aerosol-generating substrates according to the invention may also be used in heated smoking articles comprising combustible heat sources having different constructions. It will also be appreciated that aerosol-generating substrates according to the invention may be used in heated smoking articles comprising non-combustible heat sources. For example, aerosol-generating substrates according to the invention may be used in heated smoking articles comprising chemical heat sources. In addition, aerosol-generating substrates according to the invention may be used in heated smoking articles comprising electric resistive heating elements or other electrical heat sources.

According to the invention there is provided a method of making a smoking article comprising: forming an aerosol-generating substrate comprising a plurality of individual strands of homogenized tobacco material comprising at least one aerosol former characterised in that the individual strands of homogenized tobacco material have a mass-to-surface-area ratio of between about 0.09 $mg/mm^2$ and about 0.25 $mg/mm^2$ and an aerosol former content of between about 12% and about 25% by weight; and incorporating the aerosol-generating substrate in a smoking article.

According to the invention, there is further provided a smoking article comprising a heat source and an aerosol-generating substrate comprising a plurality of individual strands of homogenized tobacco material comprising at least one aerosol former characterised in that the individual strands of homogenized tobacco material have a mass-to-surface-area ratio of between about 0.09 $mg/mm^2$ and about 0.25 $mg/mm^2$ and an aerosol former content of between about 12% and about 25% by weight.

Preferably, the aerosol-generating substrate is located downstream of the heat source.

As used herein, the terms 'upstream' and 'front', and 'downstream' and 'rear', are used to describe the relative positions of components, or portions of components, of smoking articles according to the invention in relation to the direction of air drawn through smoking articles during use thereof.

Preferably, the heat source and the aerosol-generating substrate abut against one another.

Preferably, smoking articles according to the invention further comprise a heat-conducting element around and in contact with a rear portion of the heat source and an adjacent front portion of the aerosol-generating substrate.

Preferably, the heat source is a combustible heat source. More preferably, the heat source is a combustible carbon-based heat source.

EXAMPLES ACCORDING TO THE INVENTION

Strands of homogenized tobacco material according to the invention of substantially rectangular cross-section having the dimensions, densities, mass-to-surface-area ratios and aerosol former contents shown in Table 1 (samples 1 to 4) are produced by the manufacturing processes indicated in Table 1.

COMPARATIVE EXAMPLES NOT ACCORDING TO THE INVENTION

For the purpose of comparison, strands of homogenized tobacco material not according to the invention of substantially rectangular cross-section having the dimensions, surface areas, masses, mass-to-surface-area ratios, densities and aerosol former contents shown in Table 1 (samples 5 to 7) are produced by the manufacturing processes indicated in Table 1.

The resistance to combustion in response to convective heat transfer of the strands of homogenized tobacco material according to the invention of samples 1 to 4 and the strands of homogenized tobacco material not according to the invention of samples 5 to 7 were assessed.

For each sample, five aerosol-generating substrates comprising a plurality of strands of the homogenized tobacco material are produced having a length of 7.1 mm, a diameter of 8 mm, a mass of 180 mg and a density of 0.5 $g/cm^3$.

To form the aerosol-generating substrates, 180 mg of the strands of homogenized tobacco material are placed in a cylindrical quartz tube 10 (see FIG. 1) having an internal diameter of 8 mm and held in place by a stainless steel wire gauze 12 to form a plug 14 of 7.1 mm in length. The quartz tube is placed in a stainless steel outer jacket (not shown). As shown in FIG. 1, the cylindrical quartz tube 10 is coupled to a hot air-generator comprising a nickel-chromium heating filament 16 wound on a ceramic support 18 and held in a second quartz tube 20 with a perforated ceramic screen 22.

The perforated ceramic screen 22 of the hot-air generator minimises heating of the plug 14 by radiation. A distance of between about 0.5 mm and about 1 mm is maintained between the plug 14 and the perforated ceramic screen 22 of the hot-air generator to also minimise heating of the plug 14 by conduction. The structure of the hot-air generator and location of the plug 14 thus favors convective heating of the plug 14.

The strands of homogenized tobacco material are conditioned for 48 hours in 60% relative humidity at 22° C. prior to being placed in the quartz tube for assessment of their resistance to combustion. To assess the resistance to combustion of the strands of homogenized tobacco material in response to convective heat transfer, the nickel-chromium heating filament 16 of the hot air-generator is heated by a regulated power supply of 63 W and twelve puffs of 55 ml (puff volume) are drawn over 2 seconds each (puff duration) every 30 seconds (puff frequency) in the direction shown by the arrows in FIG. 1 using a programmable dual syringe pump.

Visual confirmation of combustion may be obtained by the observation of combustion spots (white ashes against the dark tobacco) on the surface of the upstream end (that is, the end closest to the nickel-chromium heating filament 16 of the hot air-generator) of a plug 14 after convective heating. This allows a qualitative ranking of the resistance to combustion of the strands of homogenized tobacco material of each sample.

In addition, a semi-quantitative determination of combustion of the strands of homogenized tobacco material is obtained by analysis of the isoprene content of the aerosol generated during the twelve puffs; as explained above, isoprene is a pyrolysis product of isoprenoid compounds present in tobacco, for example in certain tobacco waxes. Isoprene can be present in the aerosol only if the strands of homogenized tobacco material are heated to a temperature substantially higher than that required to generate the aerosol. Thus, isoprene yield can be taken as representative of the amount of homogenized tobacco material that is over heated. The isoprene content of the aerosol generated during the twelve puffs is measured by gas chromatography.

As shown in Table 1, the aerosols generated from the plugs comprising strands of homogenized tobacco material according to the invention (samples 1 to 4) all contain 3 micrograms or less of isoprene per 12 puffs. Furthermore, the aerosols generated from the plugs comprising strands of homogenized tobacco according to the invention of samples 1 to 3 contain no detectable isoprene. This shows that the tobacco in the strands of homogenized tobacco material according to the invention having a mass-to-surface-area ratio of at least about 0.09 mg/mm$^2$ and an aerosol former content of between about 12% and about 25% by weight is not significantly over heated as a result of convective heat transfer from the hot air drawn through the plugs. In contrast, as shown in Table 1, the aerosols generated from the plugs comprising strands of homogenized tobacco material not according to the invention (samples 5 to 7) all contain significant quantities of isoprene. This shows that the tobacco in the strands of homogenized tobacco material not according to the invention having an aerosol former content of less than 12% by weight (sample 5) or a mass-to-surface-area ratio of less than 0.09 mg/mm$^2$ (samples 6 and 7) is significantly over heated as a result of convective heat transfer from the hot air drawn through the plugs.

After convective heating, the five plugs formed from the strands of homogenized tobacco material of each sample were also visually inspected for signs of combustion. Photographs of the upstream end of three of the plugs formed from the strands of homogenized tobacco material of samples 1 to 7 after convective heating thereof are shown in FIGS. 2 to 8, respectively. As shown in FIGS. 2 to 8, due to the set-up of the apparatus used to heat the plugs by convective heat transfer shown in FIG. 1, the strands of homogenized tobacco material of each sample are not aligned substantially parallel to one another in the plugs. However, for the reasons previously stated above, the plurality of strands of homogenized tobacco material within aerosol-generating substrates according to the invention are preferably aligned substantially parallel to one another.

Figure 6:
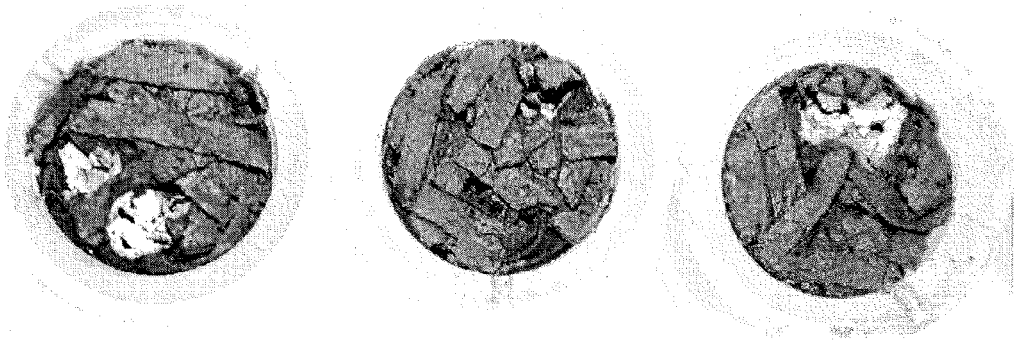
FIG. 6 shows strands of homogenized tobacco material having a mass-to-surface-area ratio of 0.11 mg/mm$^2$ and an aerosol former content of 10% not according to the invention after convective heating thereof.
Figure 7:
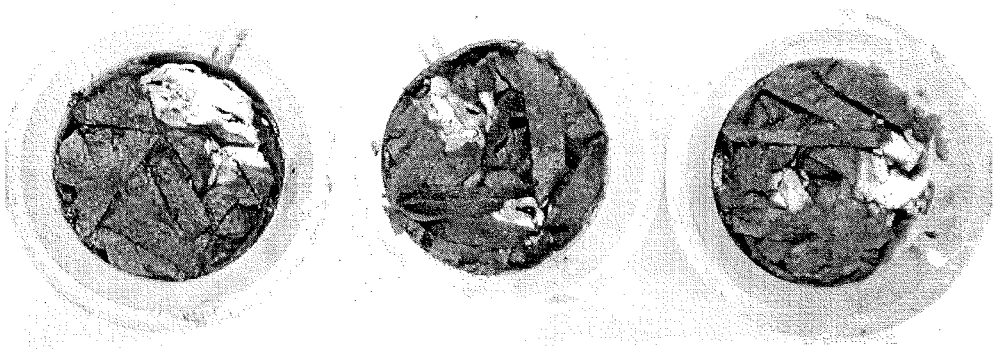
FIG. 7 shows strands of homogenized tobacco material having a mass-to-surface-area ratio of 0.08 mg/mm$^2$ and an aerosol former content of 15% not according to the invention after convective heating thereof.
Figure 8:
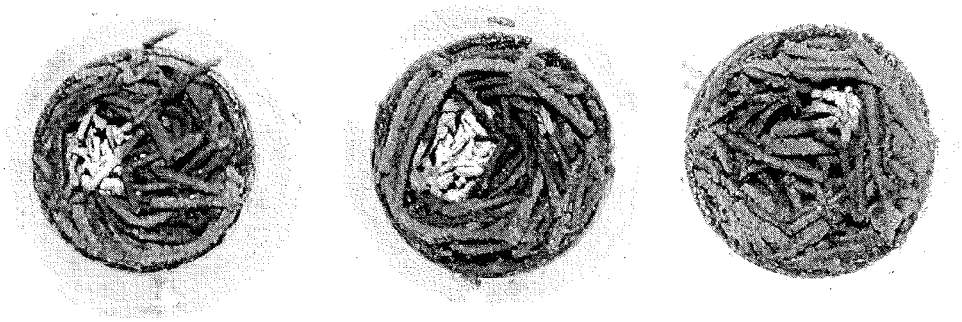
FIG. 8 shows strands of homogenized tobacco material having a mass-to-surface-area ratio of 0.08 mg/mm$^2$ and an aerosol former content of 20% not according to the invention after convective heating thereof.

As shown in FIGS. 2 to 5, the plugs comprising strands of homogenized tobacco material according to the invention (samples 1 to 4) do not show any significant visual signs of combustion. In contrast, as shown in FIGS. 6 to 8, the plugs comprising strands of homogenized tobacco material not according to the invention (samples 5 to 7) all show significant visual signs of combustion in the form of localized white combustion spots.

For comparison, an assessment of the resistance to combustion in response to convective heating of the aerosol-generating substrate of a heated smoking article sold under the brand name Steam Hot One by Japan Tobacco Inc. was also made in the same manner using the apparatus shown in FIG. 1. The Steam Hot One heated smoking article comprises a combustible carbon-based heat source and an aerosol-generating substrate consisting of a plug comprising a plurality of strands of tobacco material downstream of the combustible heat source. It is believed that the aerosol-generating substrate of the Steam Hot One heated smoking article comprises a mixture of roughly 60% by weight of strands of tobacco cut filler and roughly 40% by weight of strands of reconstituted tobacco. The strands of tobacco material of the aerosol-generating substrate of the Steam Hot One heated smoking article have an average mass-to-surface-area ratio of about 0.06 mg/mm$^2$ and an average aerosol former (glycerin) content of about 26% by weight.

Like the aerosols generated from the other plugs comprising strands of homogenized tobacco material not according to the invention (samples 5 to 7), the aerosols generated from plugs comprising strands of tobacco material from the Steam Hot One heated smoking article contain significant quantities of isoprene (13.08 micrograms per plug). In addition, the plugs show significant visual signs of combustion in the form of localized white combustion spots.

While the invention has been exemplified above with reference to strands of homogenized tobacco material having a length of 10 mm, it will be appreciated that strands of homogenized tobacco material may be of different length.

In addition, while the invention has been exemplified above with reference to strands of homogenized tobacco material of substantially rectangular cross-section, it will be appreciated that strands of homogenized tobacco material may be of different shape. For example, strands of homogenized tobacco material according to the invention may alternatively be strands of substantially square transverse cross-section or substantially circular cross-section.

In this specification, the word "about" is sometime used in connection with numerical values to indicate that mathematical precision is not intended. Accordingly, where the word "about" is used with a numerical value, that numerical value should be interpreted to include a tolerance ±10% of the stated numerical value.

It will now be apparent to those skilled in the art that the foregoing specification describes with particularity homogenized tobacco strands, aerosol-generating substrates, and smoking articles. Moreover, it will also be apparent to those skilled in the art that various modifications, substitutions, variations, and equivalents exist for claimed features of those homogenized tobacco strands, aerosol-generating substrates, and smoking articles. Accordingly, it is expressly intended that all such modifications, substitutions, variations, and equivalents for claimed features of those strands, substrates, and articles, which fall within the spirit and scope of the invention as defined by the appended claims, be embraced thereby.

TABLE 1

| | Examples according to the invention | | | | Comparative examples not according to the invention | | |
|---|---|---|---|---|---|---|---|
| Sample: | 1 | 2 | 3 | 4 | 5 | 6 | 7 |
| Strand of homogenized tobacco material: | | | | | | | |
| Manufacturing process | E | DR | E | CL | CL | CL | E |
| Length of strand (mm) | 10 | 10 | 10 | 10 | 10 | 10 | 10 |
| Width of strand (mm) | 0.9 | 0.9 | 0.7 | 0.9 | 0.9 | 0.9 | 0.3 |
| Thickness of strand (mm) | 0.50 | 0.36 | 0.20 | 0.25 | 0.25 | 0.18 | 0.20 |

TABLE 1-continued

| | Examples according to the invention | | | | Comparative examples not according to the invention | | |
|---|---|---|---|---|---|---|---|
| Sample: | 1 | 2 | 3 | 4 | 5 | 6 | 7 |
| Surface area of strand ($mm^2$) | 28.90 | 25.85 | 18.28 | 23.45 | 23.45 | 21.92 | 10.12 |
| Mass of strand (mg) | 6.17 | 4.11 | 1.80 | 2.50 | 2.50 | 1.80 | 0.77 |
| Mass-to-surface-area ratio of strand ($mg/mm^2$) | 0.21 | 0.16 | 0.10 | 0.11 | 0.11 | 0.08 | 0.08 |
| Density of strand ($mg/cm^3$) | 1.37 | 1.27 | 1.29 | 1.11 | 1.11 | 1.11 | 1.29 |
| Aerosol former (glycerin) content of strand (%) | 25 | 20 | 15 | 15 | 10 | 15 | 20 |
| Aerosol-generating substrate (plug): | | | | | | | |
| Isoprene per plug (micrograms) | 0.0 | 0.0 | 0.0 | 3.0 | 18.5 | 26.8 | 33.6 |

E = extrusion; CL = cast leaf; DR = dough reconstitution

What is claimed is:

1. A strand of homogenized tobacco material comprising at least one aerosol former having a mass-to-surface-area ratio of at least about 0.09 $mg/mm^2$ and an aerosol former content of between about 12% and about 25% by weight, wherein the homogenized tobacco material has a density of between about 1100 $mg/cm^3$ and about 1450 $mg/cm^3$.

2. A strand of homogenized tobacco material according to claim 1 having a mass-to-surface-area ratio of at least about 0.1 $mg/mm^2$.

3. A strand of homogenized tobacco material according to claim 1 having a mass-to-surface-area ratio of less than or equal to about 0.25 $mg/mm^2$.

4. A strand of homogenized tobacco material according to claim 1 having an aerosol former content of between about 15% and about 25% by weight.

5. A strand of homogenized tobacco material according to claim 1 further including at least one flavorant in an amount of about 10% by weight or less.

6. An aerosol-generating substrate for a smoking article comprising a plurality of strands of homogenized tobacco material comprising at least one aerosol former having a mass-to-surface-area ratio of at least about 0.09 $mg/mm^2$, an aerosol former content of between about 12% and about 25% by weight, and a density of between about 0.5 $g/cm^3$ and about 1.0 $g/cm^3$.

7. An aerosol-generating substrate according to claim 6 wherein the plurality of strands of homogenized tobacco material are aligned substantially parallel to one another within the aerosol-generating substrate.

8. An aerosol-generating substrate for a smoking article including homogenized tobacco material comprising at least one aerosol former having a mass-to-surface-area ratio of at least about 0.09 $mg/mm^2$, an aerosol former content of between about 12% and about 25% by weight, and the aerosol-generating substrate having a density of between about 0.5 $g/cm^3$ and about 1.0 $g/cm^3$.

9. A smoking article comprising:

a heat source; and an aerosol-generating substrate having a plurality of strands of homogenized tobacco material having at least one aerosol former with a mass-to-surface-area ratio of at least about 0.09 $mg/mm^2$, an aerosol former content of between about 12% and about 25% by weight, and the aerosol-generating substrate having a density of between about 0.5 $g/cm^3$ and about 1.0 $g/cm^3$.

10. A smoking article according to claim 9 wherein the aerosol-generating substrate is located downstream of the heat source.

11. A smoking article according to claim 10 wherein the heat source is a combustible heat source.

12. A smoking article according to claim 11 further comprising:

a heat-conducting element around and in contact with a rear portion of the combustible heat source and an adjacent front portion of the aerosol-generating substrate.

13. A method of making a smoking article comprising:

forming an aerosol-generating substrate having a plurality of strands of homogenized tobacco material comprising at least one aerosol former having a mass-to-surface-area ratio of at least about 0.09 $mg/mm^2$, an aerosol former content of between about 12% and about 25% by weight, and the aerosol-generating substrate having a density of between about 0.5 $g/cm^3$ and about 1.0 $g/cm^3$; and incorporating the aerosol-generating substrate in a smoking article.

* * * * *